US006823858B1

(12) United States Patent
Chen

(10) Patent No.: US 6,823,858 B1
(45) Date of Patent: Nov. 30, 2004

(54) FOLDABLE CONDUCTION OVEN (IV)

(76) Inventor: Gao-Shan Chen, No. 2, Alley 492, Hai Tian Rd. Sec. 2, Tainan City (TW)

( * ) Notice: Subject to any disclaimer, the term of this patent is extended or adjusted under 35 U.S.C. 154(b) by 144 days.

(21) Appl. No.: 10/446,843

(22) Filed: May 29, 2003

(51) Int. Cl.[7] ..... F24C 1/16

(52) U.S. Cl. ..... 126/9 R; 126/9 B; 126/25 R; 126/38

(58) Field of Search ..... 126/9 R, 9 A, 126/9 B, 25 R, 38

(56) References Cited

U.S. PATENT DOCUMENTS 3,297,017 A * 1/1967 Levin ..... 126/25 A
3,490,433 A * 1/1970 Busenbarrick ..... 126/9 R
3,812,839 A * 5/1974 Helgeson ..... 126/38
4,363,313 A * 12/1982 Smith ..... 126/9 R
4,489,706 A * 12/1984 Hait ..... 126/9 R
4,548,192 A * 10/1985 Hsu ..... 126/25 R
4,569,327 A * 2/1986 Velten ..... 126/25 A
4,598,690 A * 7/1986 Hsu ..... 126/25 R
4,706,817 A * 11/1987 Greathouse ..... 206/545
4,714,013 A * 12/1987 Telfer ..... 99/449
4,920,950 A * 5/1990 Johnson ..... 126/29
5,293,859 A * 3/1994 Lisker ..... 126/26
5,970,971 A * 10/1999 Wu ..... 126/38
6,439,111 B1 * 8/2002 Lu ..... 99/449
6,591,828 B1 * 7/2003 Schneider ..... 126/9 R
2003/0029434 A1 * 2/2003 Liu ..... 126/25 R

FOREIGN PATENT DOCUMENTS

JP 2001041455 A * 2/2001 ..... F24B/1/20

* cited by examiner

*Primary Examiner*—Jiping Lu

(57) ABSTRACT

A foldable conduction oven comprises by a pedestal, a grill and a net. The pedestal comprises by two opposite outward plates, two opposite outward cover plates and a chassis. The riveting part of the four lugs, which are on the four edges of the chassis, and the four lugs, which are on the two outward cover plates, is the revolving central of the chassis and the two outward cover plates. It makes the two outward cover plates to revolve 90°. The riveting part of the four round holes, which are on the two side edges of the two long prominences of the chassis, and the four round holes, which are on the edges of the two outward plates, is the revolving central of the chassis and the two outward plates. It makes the two outward plates to revolve 90°. When unfold the two outward plates and the two outward cover plates, the prominent pellets on the inner side of the two outward plates, which are against the inner up sides of the two outward cover plates, are used to fasten the pedestal. The foldable conduction oven provides convenience and practicability, because the invention is able to be folded or unfolded without any tools and easy to be carried or picked up.

5 Claims, 5 Drawing Sheets

FOLDABLE CONDUCTION OVEN (IV)

BACKGROUND OF THE INVENTION

The present invention relates to a conduction oven, and more particularly to a foldable conduction oven which is folded or unfolded quickly without any tools and easy to be carried or picked up.

A conventional conduction oven isn't foldable without tools and the space is always wasted because of the large volume of a conventional conduction oven.

SUMMARY OF THE INVENTION

A foldable conduction oven comprises by a pedestal, a grill and a net.

The pedestal comprises by two opposite outward plates, two opposite outward cover plates and a chassis. The riveting part of the four lugs, which are on the four edges of the chassis, and the four lugs, which are on the two outward cover plates, is the revolving central of the chassis and the two outward cover plates. It makes the two outward cover plates to revolve 90°. The riveting part of the four round holes, which are on the two side edges of the two long prominences of the chassis, and the four round holes, which are on the edges of the two outward plates, is the revolving central of the chassis and the two outward plates. It makes the two outward plates to revolve 90°.

When unfold the two outward plates and the two outward cover plates, the prominent pellets on the inner side of the two outward plates, which are against the inner up sides of the two outward cover plates, are used to fasten the pedestal. The foldable conduction oven provides convenience and practicability, because the invention is able to be folded or unfolded without any tools and easy to be carried or picked up.

DETAILED DESCRIPTION OF THE INVENTION

Figure 1:
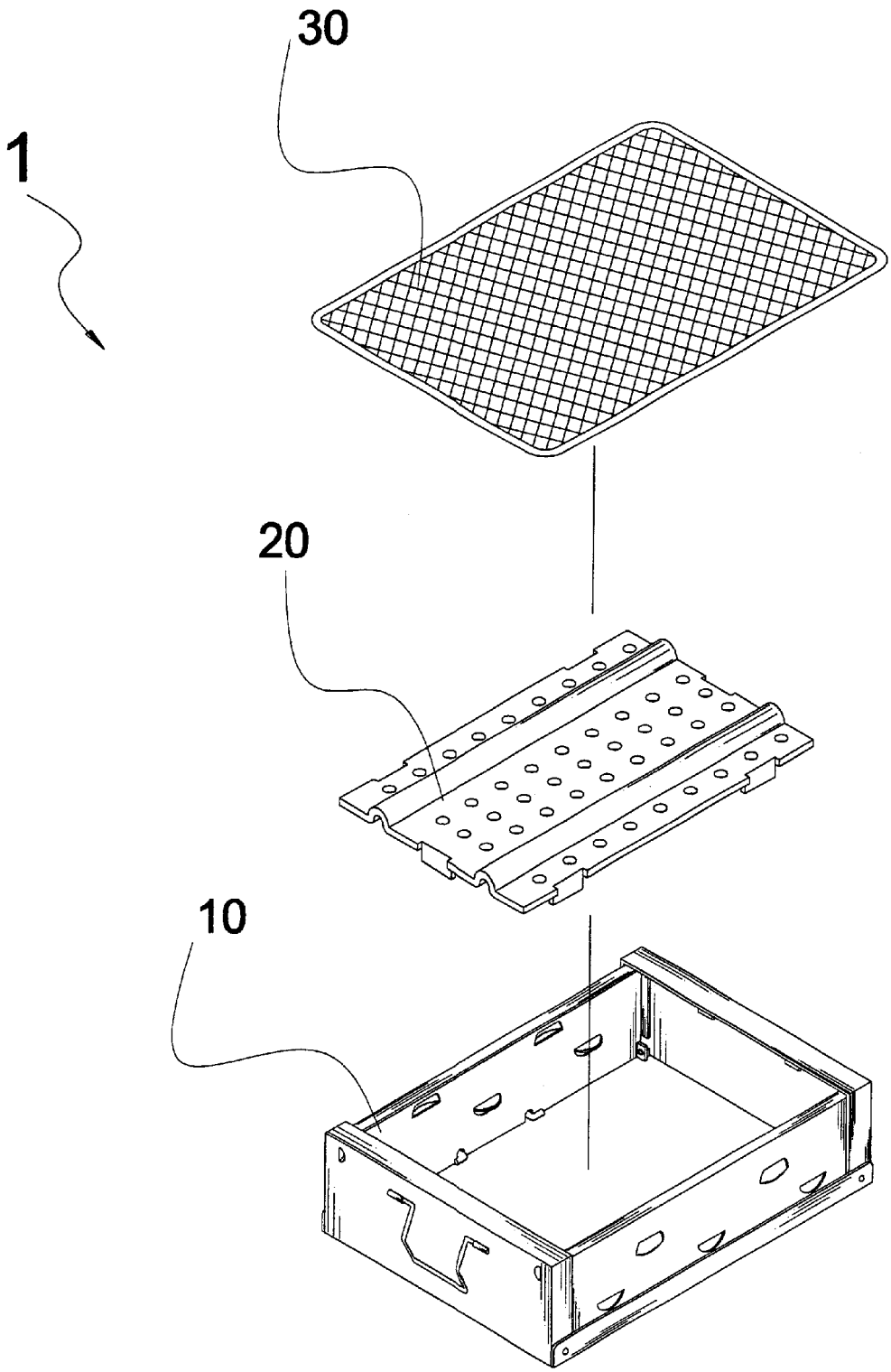
FIG. 1 is a perspective exploded view of a foldable conduction oven in accordance with this invention.
Figure 2:
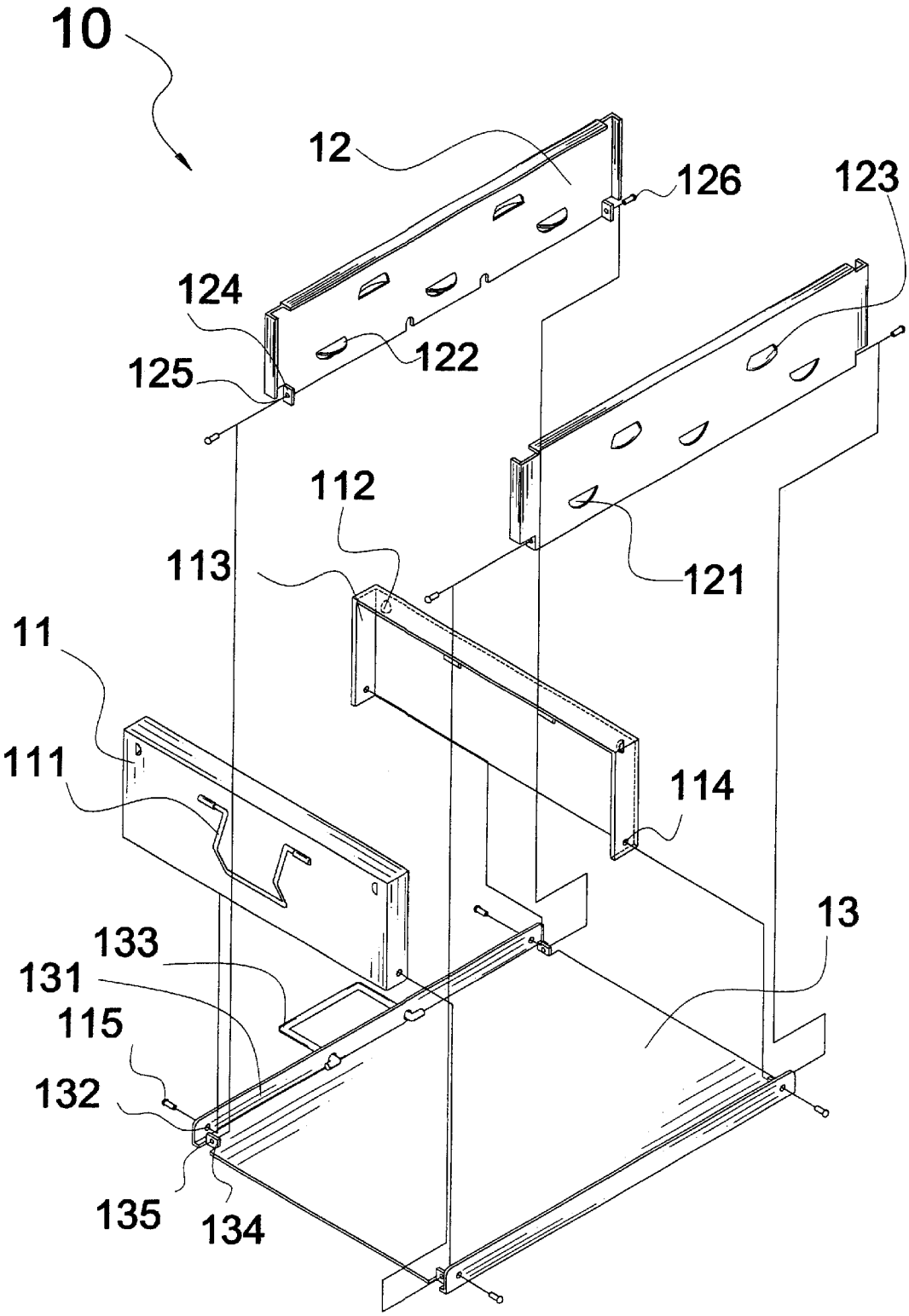
FIG. 2 is a perspective exploded view of a pedestal of a foldable conduction oven in accordance with this invention.

Referring to FIGS. 1 to 2, the foldable conduction oven 1 comprises by a pedestal 10, a grill 20 and a net 30.

The pedestal 10 comprises by two opposite outward plates 11, two opposite outward cover plates 12 and a chassis 13.

The each outward plate 11 has a handle 111 on the outside, two opposite prominent pellets 112 on the up inside, and two side edges 113 on two ends, one round hole 114 on end of the one side edge 113.

The each outward cover plate 12 has three punched semicircular holes 121 on the lower side, one semicircular prominence 122 on the one semicircular hole 121, and two prominent covers 123 on the upper outside and two lugs 124 on the lower inside, one round hole 125 on the one lug 124.

The chassis 13 has two long prominences 131 on two ends of the long side, two round holes 132 on the two ends of the each long prominence 131, a handle 133 on the lower side of the center of the chassis 13, four lugs 134 on four ends, one round holes 135 on the one lug 134 and the place of the four lugs 134 changes with the place of the four lugs 124 of the outward cover plates 12.

The four round holes 135 on the four lugs 134 of the chassis 13 are connected with the four round holes 125 on the four lugs 124 of the two outward cover plates 12 by four rivets 126.

The four round holes 132 on the two long prominences 131 of the chassis 13 are connected with the four round holes 114 on the four side edges 113 of the two outward plates 11 by four rivets 115.

Figure 3:
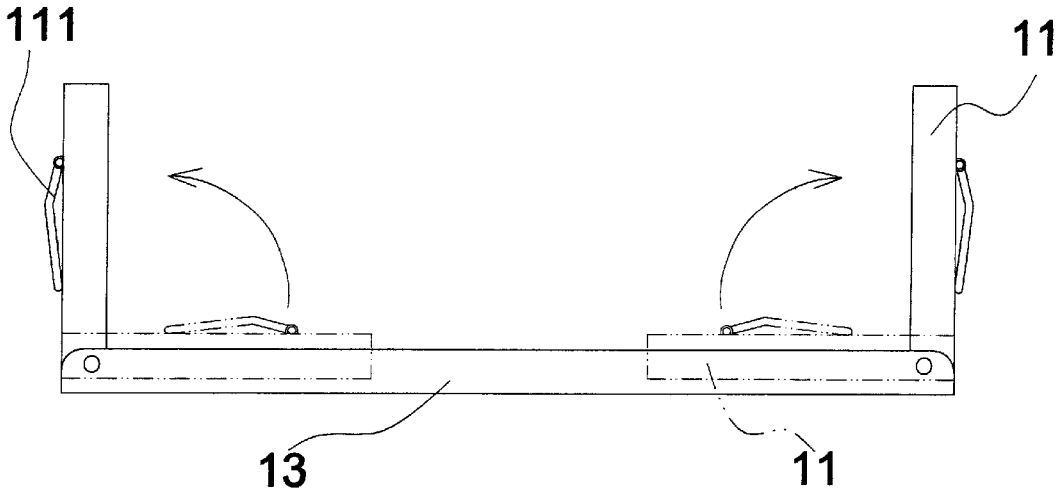
FIG. 3 is an operate diagram of an unfolded outward plates of a pedestal of a foldable conduction oven in accordance with this invention.
Figure 4:
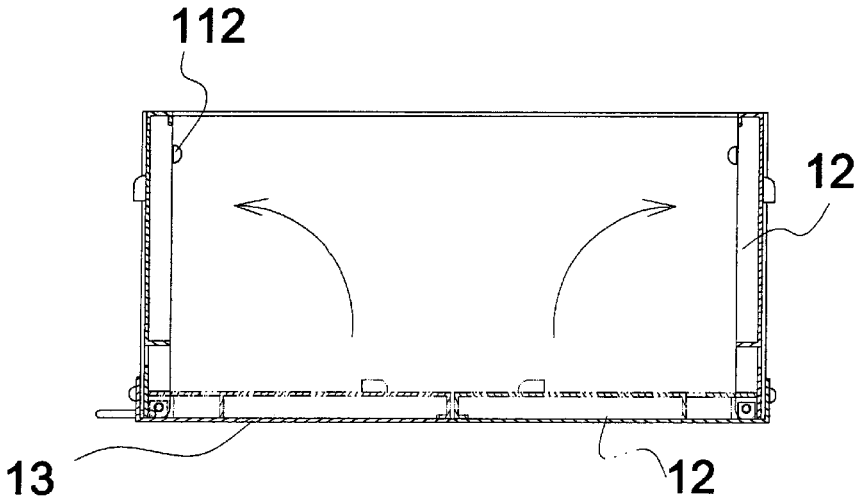
FIG. 4 is an operate diagram of an unfolded outward cover plates of a pedestal of a foldable conduction oven in accordance with this invention.

Referring to FIGS. 3 to 4, in assembly, the two outward plates 11 are unfolded and the below edges of the two outward plates 11 are against the sides of the chassis 13; the two outward cover plates 12 are unfolded and the outside surface of the outward cover plates 13 are against the long prominences 131 of the chassis 13.

Figure 5:
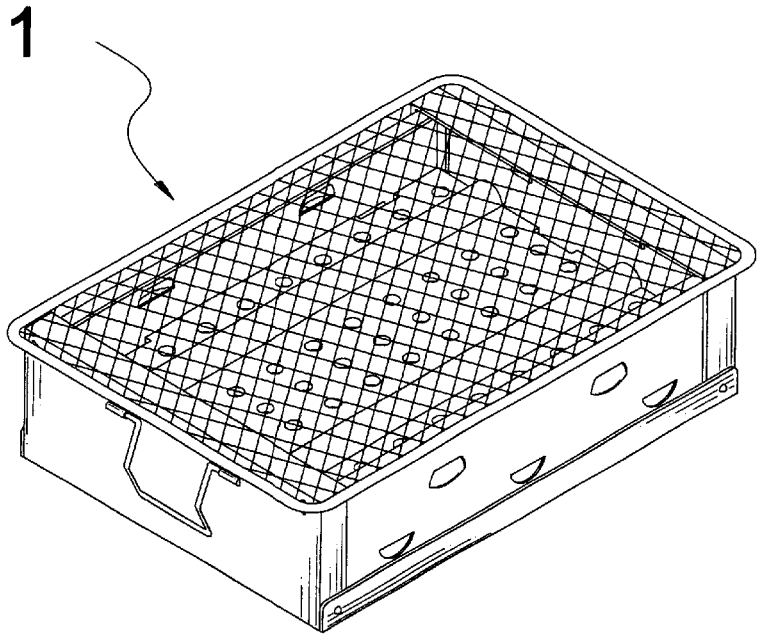
FIG. 5 is a perspective assembly view of a foldable conduction oven in accordance with this invention.

Referring to FIG. 5, the foldable conduction oven 1 is unfolded.

Figure 6:
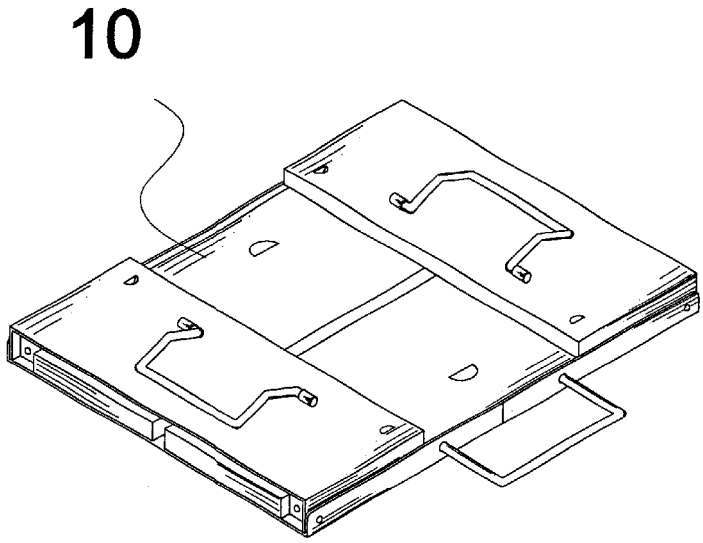
FIG. 6 is a perspective view of an unfolded pedestal of a foldable conduction oven in accordance with this invention.

Referring to FIG. 6, the pedestal 10 is folded.

Figure 7:
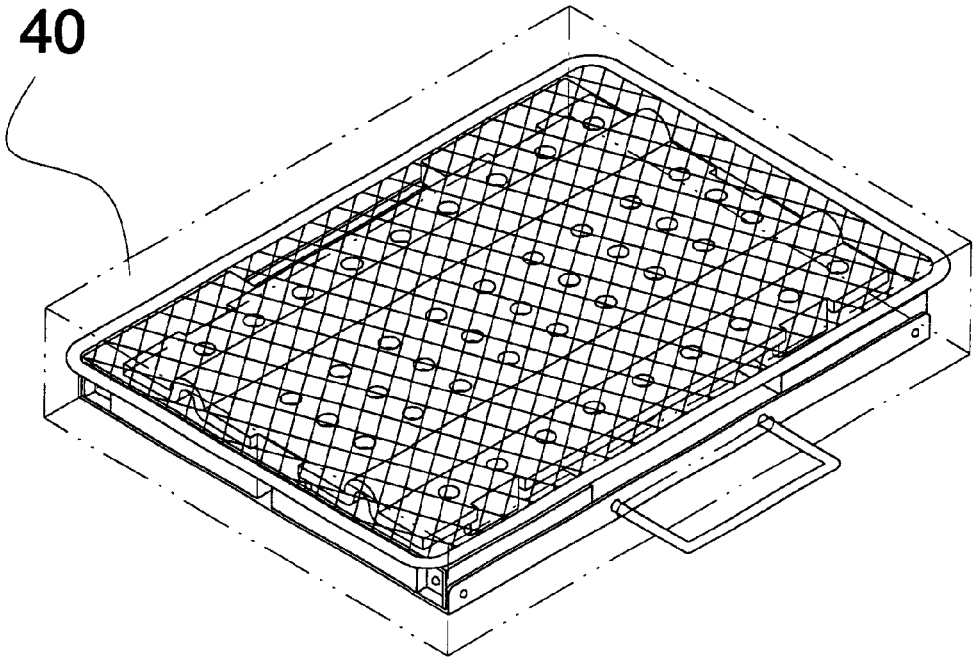
FIG. 7 is a perspective view of an unfolded foldable conduction oven in accordance with this invention in an arrange box.

Referring to FIG. 7, the foldable conduction oven 1 is folded, and the pedestal 10, the grill 20 and the net 30 are put into the arrange box 40.

I claim:

1. A foldable conduction oven comprising:

a pedestal comprising by two opposite outward plates, two opposite outward cover plates and a chassis;

the each outward plate has a handle on the outside, two opposite prominent pellets on the up inside, and two side edges on the two ends, one round hole on end of the one side edge, the each said outward cover plate has three punched semicircular holes on the lower side, one semicircular prominence on the one semicircular hole, and two prominent covers on the upper outside and two lugs on the lower inside, one round hole on the one lug, and the chassis has two long prominences on two ends of the long side, two round holes on the two ends of the each long prominence, a handle on the lower side of the center of the chassis, four lugs on four ends, one round holes on the one lug and the place of the four lugs changes with the place of the four lugs of the outward cover plates;

a grill, and a net.

2. The foldable conduction oven of claim 1, wherein the said four round holes, which are on the said four lugs of the said chassis, are connected with the said four round holes, which are on the said four lugs of the said two outward cover plates, by four rivets.

3. The foldable conduction oven of claim 1, wherein the said four round holes, which are on the said two long prominences of the said chassis, are connected with the said four round holes, on the said four side edges of the said two outward plates, by four rivets.

4. The foldable conduction oven of claim 1, wherein said two lugs, which are on lower inside of the said each outward cover plate, is able to be set on the central or upper inside of the said each outward cover plate, then the place of the said four lugs on the said chassis changes with the place of the said four lugs of the said two outward cover plates.

5. The foldable conduction oven of claim 1, wherein said two prominent pellets on the inner side of the up said each outward plates, against the inner up sides of the said two outward cover plates, is used to fasten the said pedestal when unfold the foldable conduction oven.

* * * * *